US009178319B2

(12) United States Patent
Little et al.

(10) Patent No.: US 9,178,319 B2
(45) Date of Patent: Nov. 3, 2015

(54) ELECTRICAL CONNECTOR WITH SHIELDINGTHEREOF

(71) Applicant: HON HAI PRECISION INDUSTRY CO., LTD., New Taipei (TW)

(72) Inventors: Terrance F. Little, Fullerton, CA (US); An-Jen Yang, Irvine, CA (US); Stephen Sedio, Valley Center, CA (US); Richard Lee Malehorn, II, York, PA (US); Chien-Ping Kao, Hershey, PA (US); Kuo-Chun Hsu, New Taipei (TW); Wei-Hung Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 4 days.

(21) Appl. No.: 14/149,788

(22) Filed: Jan. 7, 2014

(65) Prior Publication Data

US 2014/0194005 A1 Jul. 10, 2014

Related U.S. Application Data

(60) Provisional application No. 61/750,312, filed on Jan. 8, 2013.

(51) Int. Cl.
*H01R 13/648* (2006.01)
*H01R 13/6585* (2011.01)
*H01R 24/60* (2011.01)

(52) U.S. Cl.
CPC ..... *H01R 13/6585* (2013.01); *H01R 24/60* (2013.01)

(58) Field of Classification Search
CPC ..... H01R 23/6873; H01R 23/7073; H01R 23/7063; H01R 13/658; H01R 13/65802
USPC ..... 439/607.4, 607.09, 607.11, 607.13, 439/607.01, 607.05
See application file for complete search history.

(56) References Cited

U.S. PATENT DOCUMENTS

| | | | | |
|---|---|---|---|---|
| 6,350,134 | B1 * | 2/2002 | Fogg et al. | 439/79 |
| 6,619,968 | B2 * | 9/2003 | Xu | 439/79 |
| 7,153,162 | B2 * | 12/2006 | Mizumura et al. | 439/607.11 |
| 7,179,127 | B2 * | 2/2007 | Shiu | 439/607.35 |
| 7,670,156 | B2 * | 3/2010 | Chen | 439/108 |
| 7,744,416 | B2 * | 6/2010 | Zhang et al. | 439/607.11 |
| 7,748,999 | B1 * | 7/2010 | Sun et al. | 439/79 |
| 7,758,379 | B2 * | 7/2010 | Chen | 439/607.11 |
| 7,892,007 | B2 * | 2/2011 | Scherer et al. | 439/329 |
| 8,021,188 | B1 * | 9/2011 | Ma et al. | 439/607.55 |
| 8,070,515 | B2 * | 12/2011 | Nagata et al. | 439/607.13 |

(Continued)

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

An electrical connector for mating with a plug and mounting to a printed circuit board, includes an insulative housing with a forwardly extending mating tongue thereof. A terminal module includes an insulator associated with a plurality of contacts commonly assembled into the housing. Those contacts are categorized with the differential pairs, the grounding contacts and the power contacts while each of the contacts includes a front contacting section exposed upon the mating tongue, a middle retention section retained to the insulator, and a rear tail section extending out of the housing. A metallic shielding/reinforcement plate associated with the terminal module is assembled into the housing, and includes a front region inserted into the mating tongue, a middle region with a spring tang to mechanically and electrically connected to the selected grounding contact, and a rear tail section extending out of the housing.

20 Claims, 16 Drawing Sheets

(56) References Cited

U.S. PATENT DOCUMENTS

| | | | | |
|---|---|---|---|---|
| 8,251,746 | B2 * | 8/2012 | Zhang et al. | 439/607.11 |
| 8,262,411 | B2 * | 9/2012 | Kondo | 439/607.01 |
| 8,475,216 | B2 * | 7/2013 | Tung et al. | 439/660 |
| 8,851,927 | B2 * | 10/2014 | Hsu et al. | 439/607.11 |
| 8,894,451 | B2 * | 11/2014 | Shiratori et al. | 439/885 |
| 2010/0267261 | A1 * | 10/2010 | Lin et al. | 439/218 |
| 2013/0316581 | A1 * | 11/2013 | Kao et al. | 439/607.28 |
| 2014/0113481 | A1 * | 4/2014 | Little et al. | 439/374 |

* cited by examiner

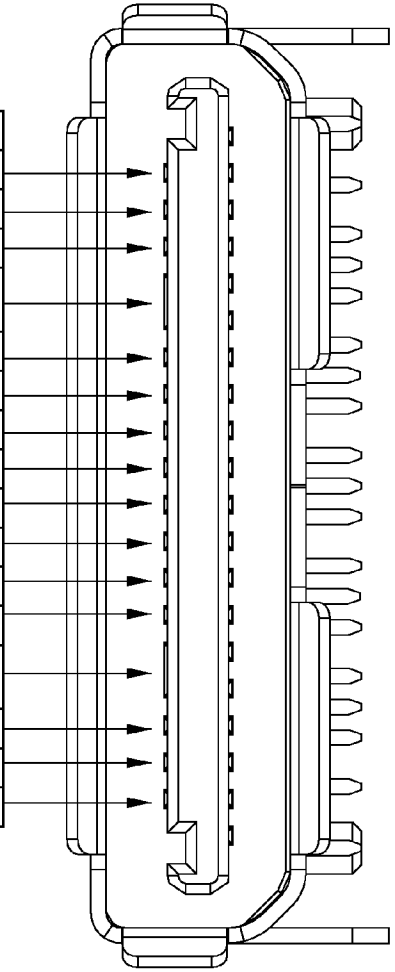

| Pin# | Mating Order | Name | Signal Description |
|---|---|---|---|
| A1 | 1ST | PWD RTN | Power Return(GND) |
| A2 | 3RD | PER3- | Next Gen IO Lane 3 Receive- |
| A3 | 3RD | PER3+ | Next Gen IO Lane 3 Receive+ |
| A4 | 1ST | PWD | Power Delivery(GND) |
| A5 | 3RD | PER2- | Next Gen IO Lane 2 Receive- |
| A6 | 3RD | PER2+ | Next Gen IO Lane 2 Receive+ |
| A7 | 1ST | PWD RTN | Power Return(GND) |
| A8 | 2ND | RES | Reserved |
| A9 | 2ND | RES | Reserved |
| A10 | 1ST | PWD RTN | Power Return(GND) |
| A11 | 3RD | PER1- | Next Gen IO Lane 1 Receive- |
| A12 | 3RD | PER1+ | Next Gen IO Lane 1 Receive+ |
| A13 | 1ST | PWD | Power Delivery(GND) |
| A14 | 3RD | PER0- | Next Gen IO Lane 0 Receive- |
| A15 | 3RD | PER0+ | Next Gen IO Lane 0 Receive+ |
| A16 | 1ST | PWD RTN | Power Return(GND) |

FIG. 15

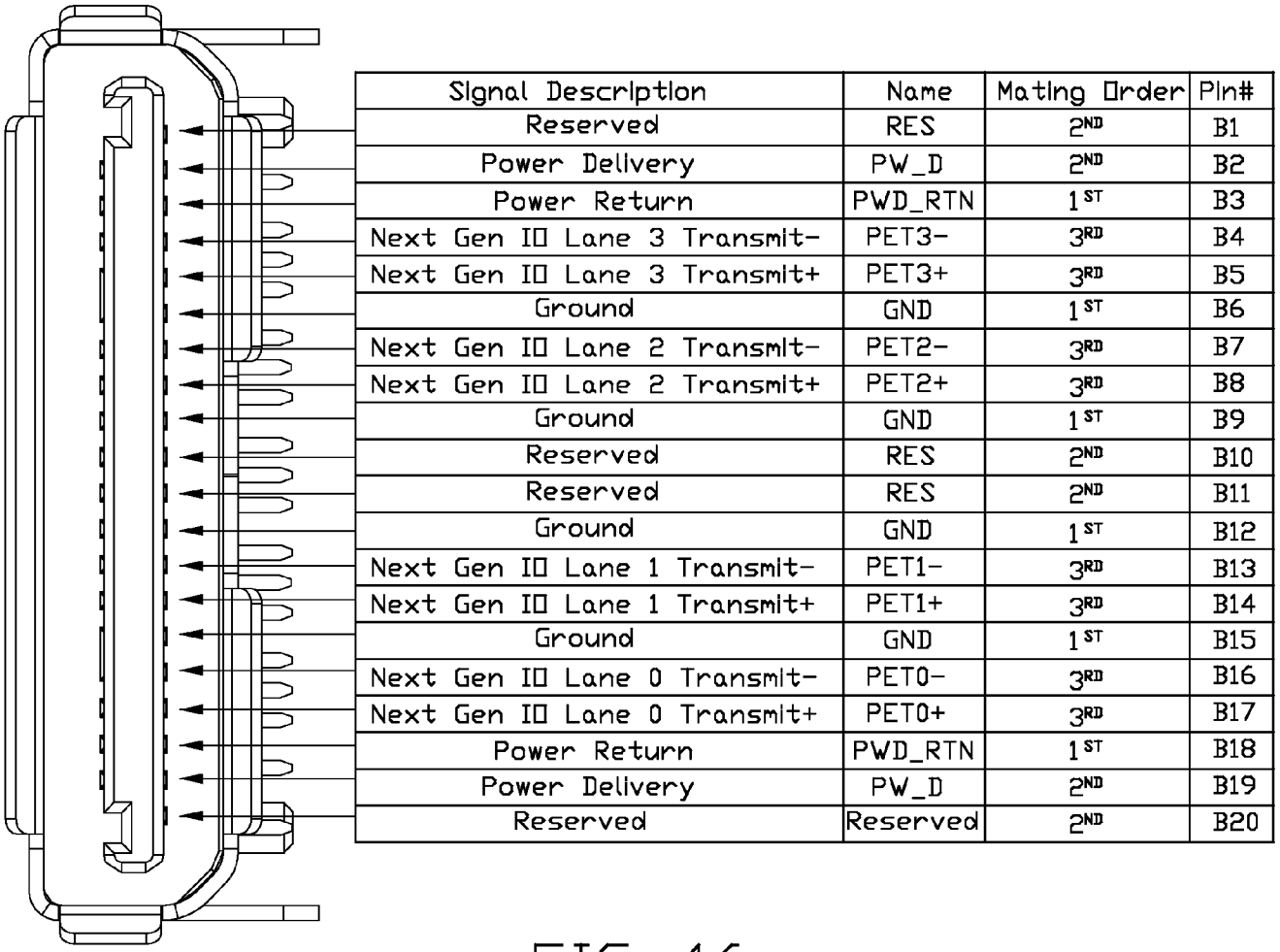

| Signal Description | Name | Mating Order | Pin# |
|---|---|---|---|
| Reserved | RES | 2ND | B1 |
| Power Delivery | PW_D | 2ND | B2 |
| Power Return | PWD_RTN | 1ST | B3 |
| Next Gen IO Lane 3 Transmit- | PET3- | 3RD | B4 |
| Next Gen IO Lane 3 Transmit+ | PET3+ | 3RD | B5 |
| Ground | GND | 1ST | B6 |
| Next Gen IO Lane 2 Transmit- | PET2- | 3RD | B7 |
| Next Gen IO Lane 2 Transmit+ | PET2+ | 3RD | B8 |
| Ground | GND | 1ST | B9 |
| Reserved | RES | 2ND | B10 |
| Reserved | RES | 2ND | B11 |
| Ground | GND | 1ST | B12 |
| Next Gen IO Lane 1 Transmit- | PET1- | 3RD | B13 |
| Next Gen IO Lane 1 Transmit+ | PET1+ | 3RD | B14 |
| Ground | GND | 1ST | B15 |
| Next Gen IO Lane 0 Transmit- | PET0- | 3RD | B16 |
| Next Gen IO Lane 0 Transmit+ | PET0+ | 3RD | B17 |
| Power Return | PWD_RTN | 1ST | B18 |
| Power Delivery | PW_D | 2ND | B19 |
| Reserved | Reserved | 2ND | B20 |

FIG. 16

ELECTRICAL CONNECTOR WITH SHIELDINGTHEREOF

CROSS REFERENCE TO RELATED APPLICATIONS

This application claims the benefit of, and priority to, U.S. Provisional Patent Application No. 61/750,312, filed Jan. 8, 2013, the contents of which are incorporated entirely herein by reference.

BACKGROUND OF THE INVENTION

1. Field of the Invention

The present invention relates to an electrical receptacle connector, and more particularly to an I/O receptacle connector having a mating tongue with contacting sections of the corresponding contacts on two opposite surfaces thereon wherein a shielding/reinforcement plate between the two opposite surface under condition that the shielding/reinforcement plate are mechanically and electrically connected to some of the grounding contacts. The invention is related to the copending application Ser. No. 13/479,289 filed May 24, 2012.

2. Description of Related Art

A connector capable of transmitting high-speed differential signals is used as an interface connector or an internal connector of a digital appliance or a PC. Such connector includes a plurality of signal contacts and a plurality of ground contacts. The signal contacts are paired in order to transmit differential signals in the manner known in the art. Generally, on the side of a fitting portion or a contacting portion side of the connector is fitted to or contacted with a mating connector. On the other hand, on the terminal portion side of the contacts to be connected to a board, the terminal portions are arranged in a plurality of rows because the terminal portions are inserted into a plurality of through holes, respectively.

At present, transmission of high-speed differential signals is required in a growing number of software applications. Under the circumstances, there is a demand for an improved connector having a compact size, a low piece, and excellent high-frequency characteristics.

SUMMARY OF THE INVENTION

Accordingly, an object of the present invention is to provide An electrical connector for mating with a plug and mounting to a printed circuit board, includes an insulative housing with a forwardly extending mating tongue thereof. A terminal module includes an insulator associated with a plurality of contacts commonly assembled into the housing. Those contacts are categorized with the differential pairs, the grounding contacts and the power contacts while each of the contacts includes a front contacting section exposed upon the mating tongue, a middle retention section retained to the insulator, and a rear tail section extending out of the housing. A metallic shielding/reinforcement plate associated with the terminal module is assembled into the housing, and includes a front region inserted into the mating tongue, a middle region with a spring tang to mechanically and electrically connected to the selected grounding contact, and a rear tail section extending out of the housing.

Other objects, advantages and novel features of the invention will become more apparent from the following detailed description when taken in conjunction with the accompanying drawings.

BRIEF DESCRIPTION OF THE DRAWINGS

FIG. 15 is a diagram to show the positions of the different categorized contacts of a receive side; and FIG. 16 is a diagram to show the positions of the different categorized contacts of a transmit side.

DETAILED DESCRIPTION OF THE PREFERRED EMBODIMENT

Reference will now be made in detail to the first preferred embodiment of the present invention.

Figure 1:
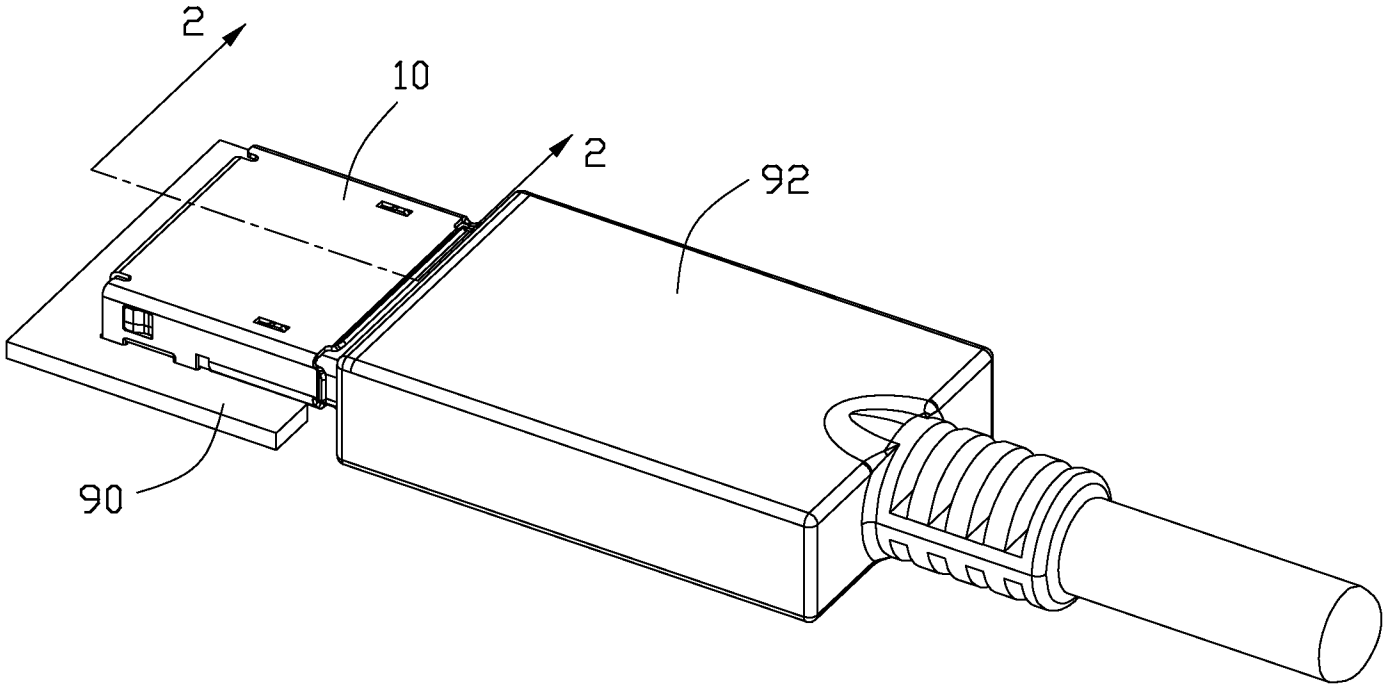
FIG. 1 is a perspective view showing the mated receptacle connector and plug connector in accordance with a first embodiment of the present invention.
Figure 2:
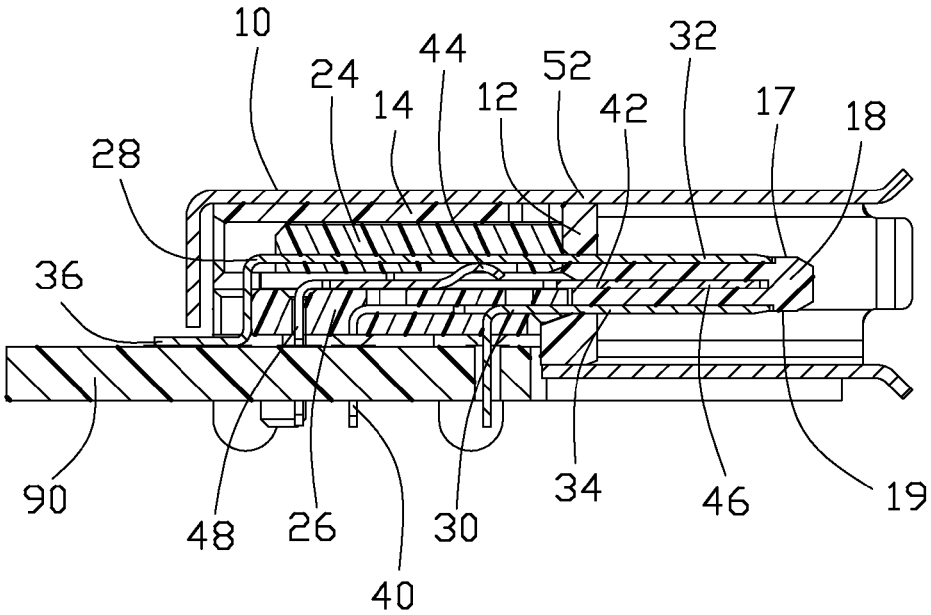
FIG. 2 is a side cross-sectional view of the receptacle connector of FIG. 1.
Figure 3:
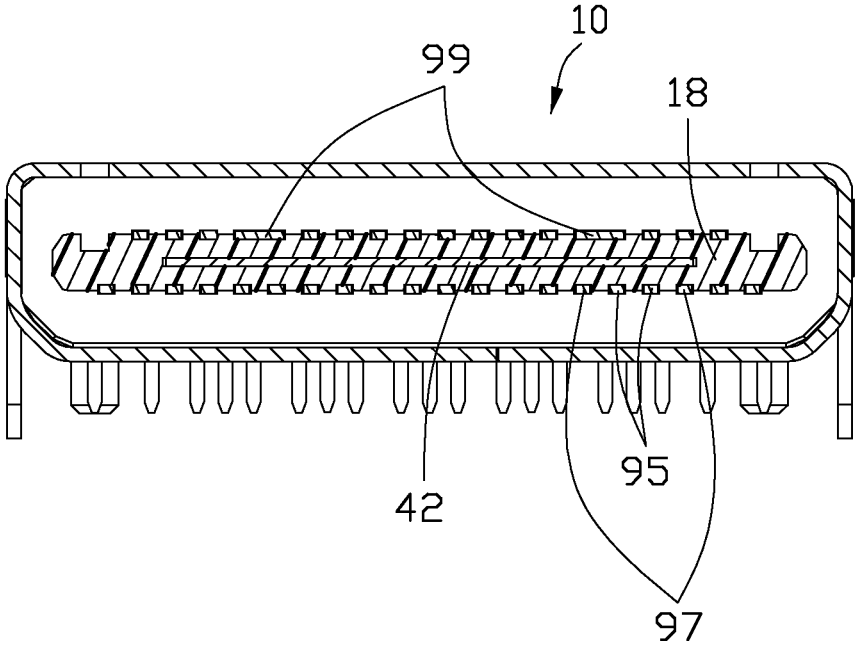
FIG. 3 is a front cross-sectional view of the receptacle connector of FIG. 1.
Figure 4:
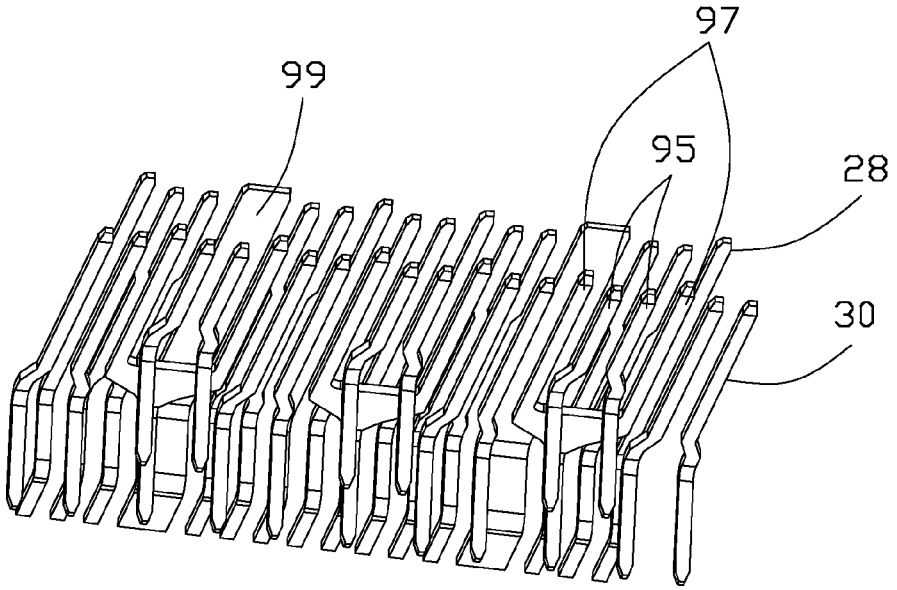
FIG. 4 is a perspective view of the contacts of the receptacle connector of FIG. 1.
Figure 5:
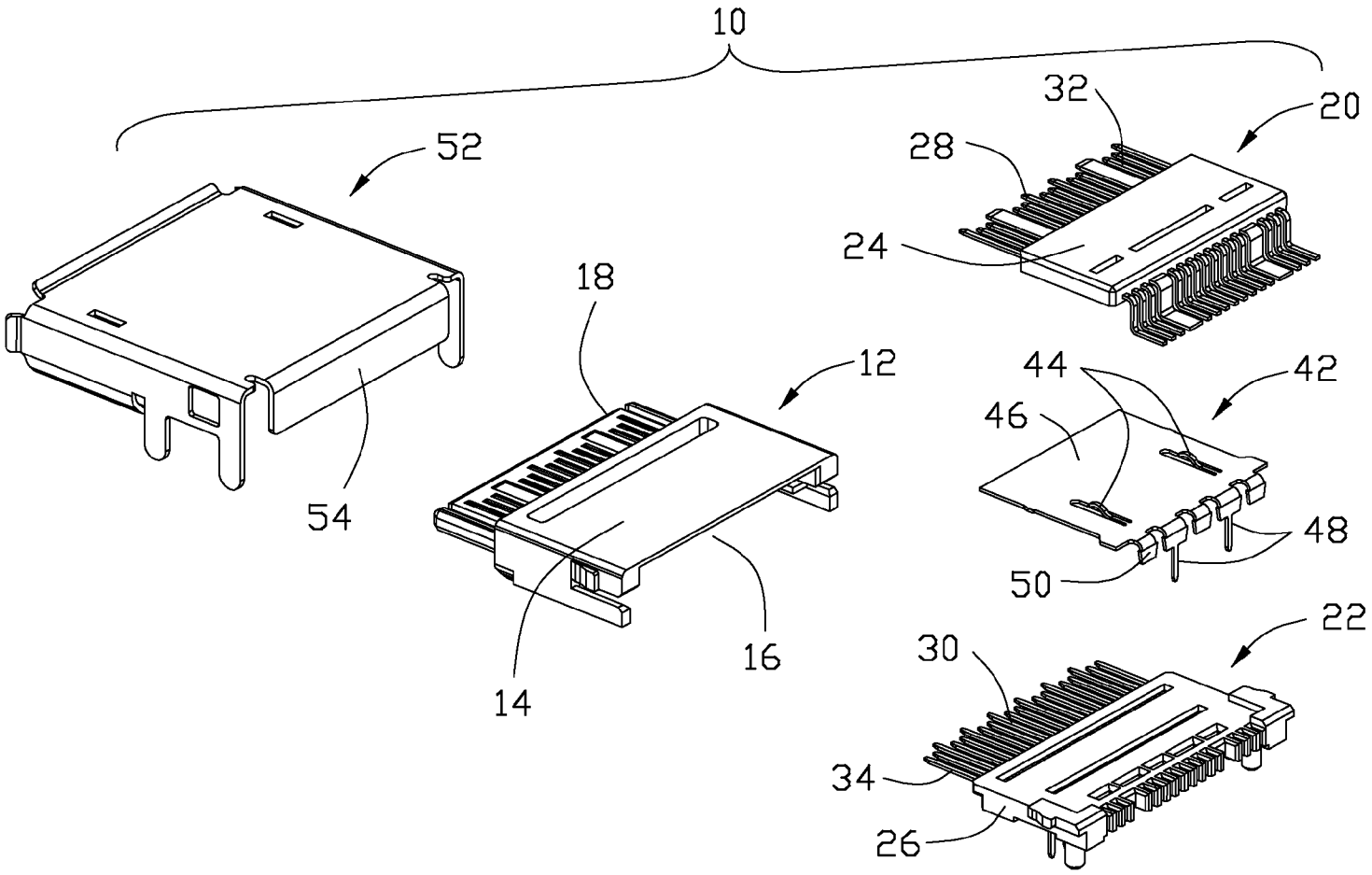
FIG. 5 is an exploded perspective view of the receptacle connector of FIG. 1.
Figure 6:
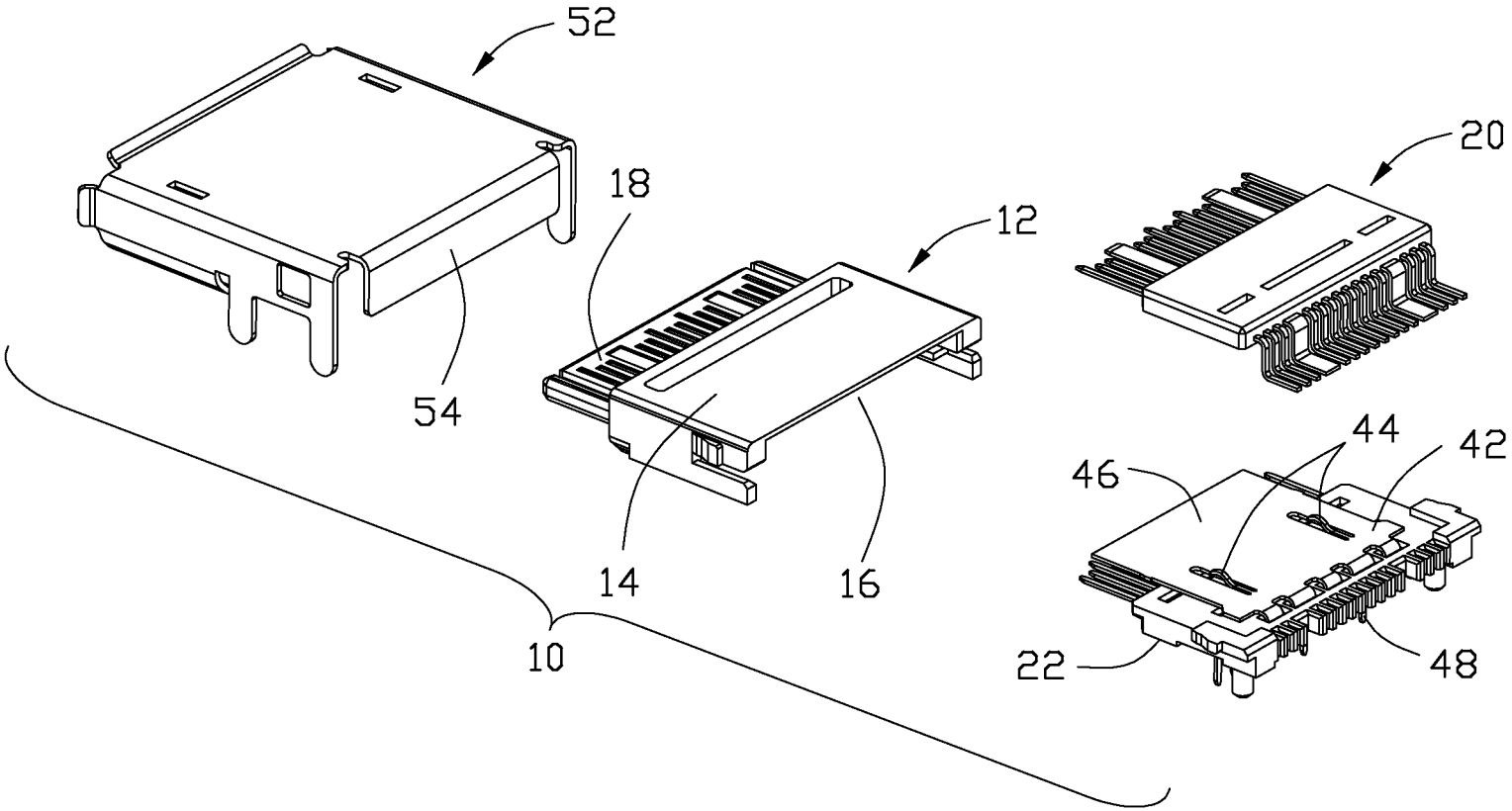
FIG. 6 is a partially exploded perspective view of the receptacle connector of FIG. 1.

Referring to FIGS. 1-7, an electrical connector assembly of a first embodiment including a receptacle connector 10 mounted upon a printed circuit board 90 and a plug cable connector 92 mated with each other. As best shown in FIGS. 5 and 6, the receptacle connector 10 includes an insulative housing 12 defining a rear base 14 with a receiving cavity 16 therein and a front mating tongue 18 extending forwardly from the base 14. The receiving cavity 16 opens rearwards. An upper/first terminal module 20 and a lower/second terminal module 22 are located behind the mating tongue 18. Each of the upper and lower terminal modules 20, 22 includes an insulator 24, 26 commonly located in the receiving cavity 16, and a plurality of upper and lower contacts 28, 30 associatively insert-molded within the corresponding insulator 24, 26 with contacting sections 32, 34 extending from font ends of the insulator 24, 26 and as shown in FIG. 2, exposed upon opposite upper and lower surfaces 17, 19 of the mating tongue 18 and tail sections 36, 40 exposed out of a rear side of the housing 12 for mounting to the printed circuit board 90. The contacts 28, 30 as best shown in FIG. 3, are categorized with differential pairs 95, the grounding contacts 97 and the power contacts 99 mixed up with one another as shown in FIG. 15.

As best shown in FIGS. 5 and 6, a metallic shielding/reinforcement plate 42 is located between the upper and lower terminal modules 20, 22 and defines a pair of spring tangs 44 extending upwardly to mechanically and electrically contact the corresponding grounding contacts 82. The shielding/reinforcement plate 42 includes a front region 46 extending into the mating tongue 18 for reinforcing the mating tongue 18, and a pair of rear tail sections 48 extending through the lower insulator 26 for mounting to the printed circuit board 90, and the mounting tabs 50 fastened to the lower insulator 26 for fastening the shielding/reinforcement plate 42 to the lower insulator 26. The mounting tabs 50 and the tail sections 48 are lined and alternated with each other.

Figure 7:
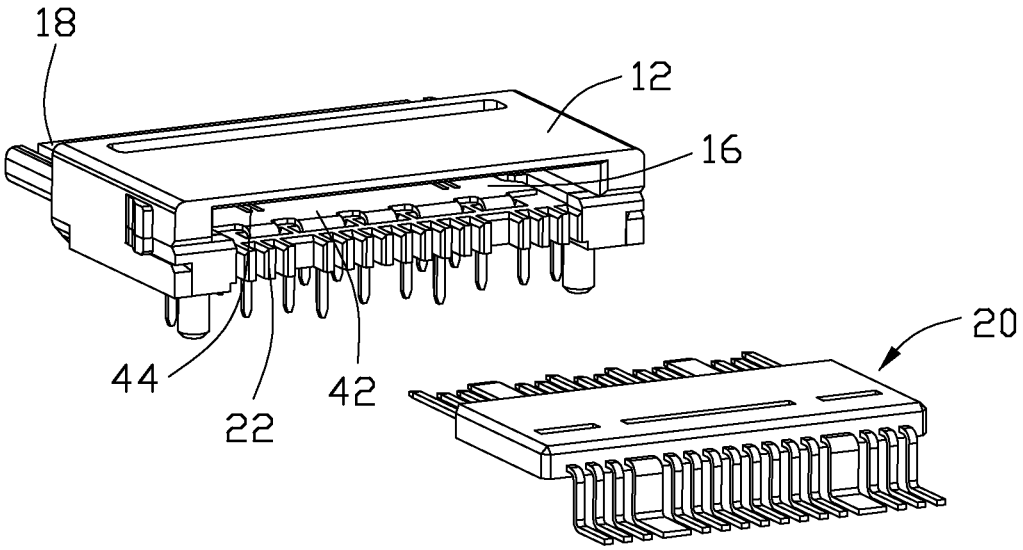
FIG. 7 is another partially exploded perspective view of the receptacle connector of FIG. 1.
Figure 8:
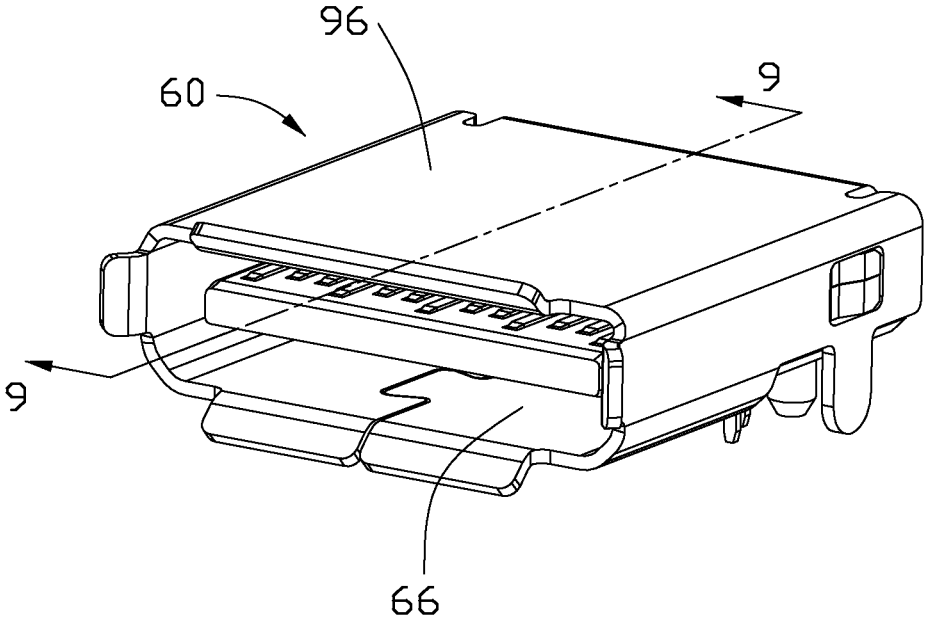
FIG. 8 is a perspective view of the receptacle connector in accordance with another embodiment of the present invention.

During assembling as best shown in FIGS. 6 and 7, the shielding/reinforcement plate 42 is first assembled to the lower insulator 26 and commonly forwardly inserted into the housing 12 from a rear side of the housing 12 wherein the contacting sections 34 of the lower contacts 30 are exposed upon the lower surface 19 of the mating tongue 18 and the lower insulator 26 is received in a lower portion of the receiving cavity 16. The upper terminal module 20 is successively forwardly inserted into an upper portion of the receiving cavity 16 with the contacting section 32 exposed upon the upper surface 17 of the mating tongue 18. The lower terminal module 22 has no projection portion higher than the spring tangs 44 so that the upper terminal module 22 is inserted into the receiving cavity 16 after the lower terminal module 22 is retained in the receiving cavity. Finally, a metallic shell 52 encloses the housing 12 and a rear wall 54 of the shell 52 is bent downwardly to shield the housing 12.

Figure 9:
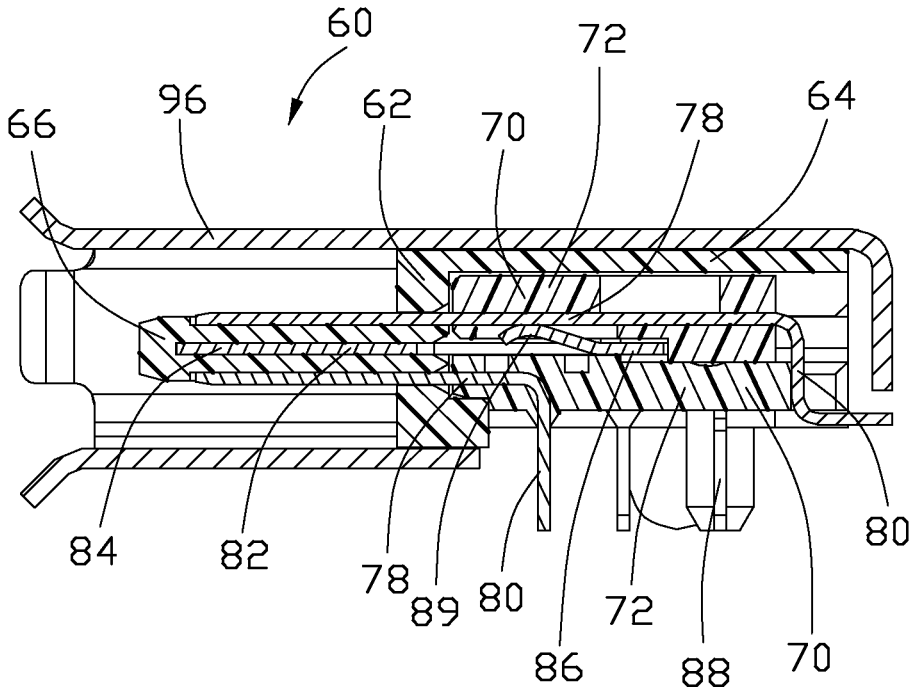
FIG. 9 is a cross-sectional view of the receptacle connector of FIG. 8.
Figure 10:
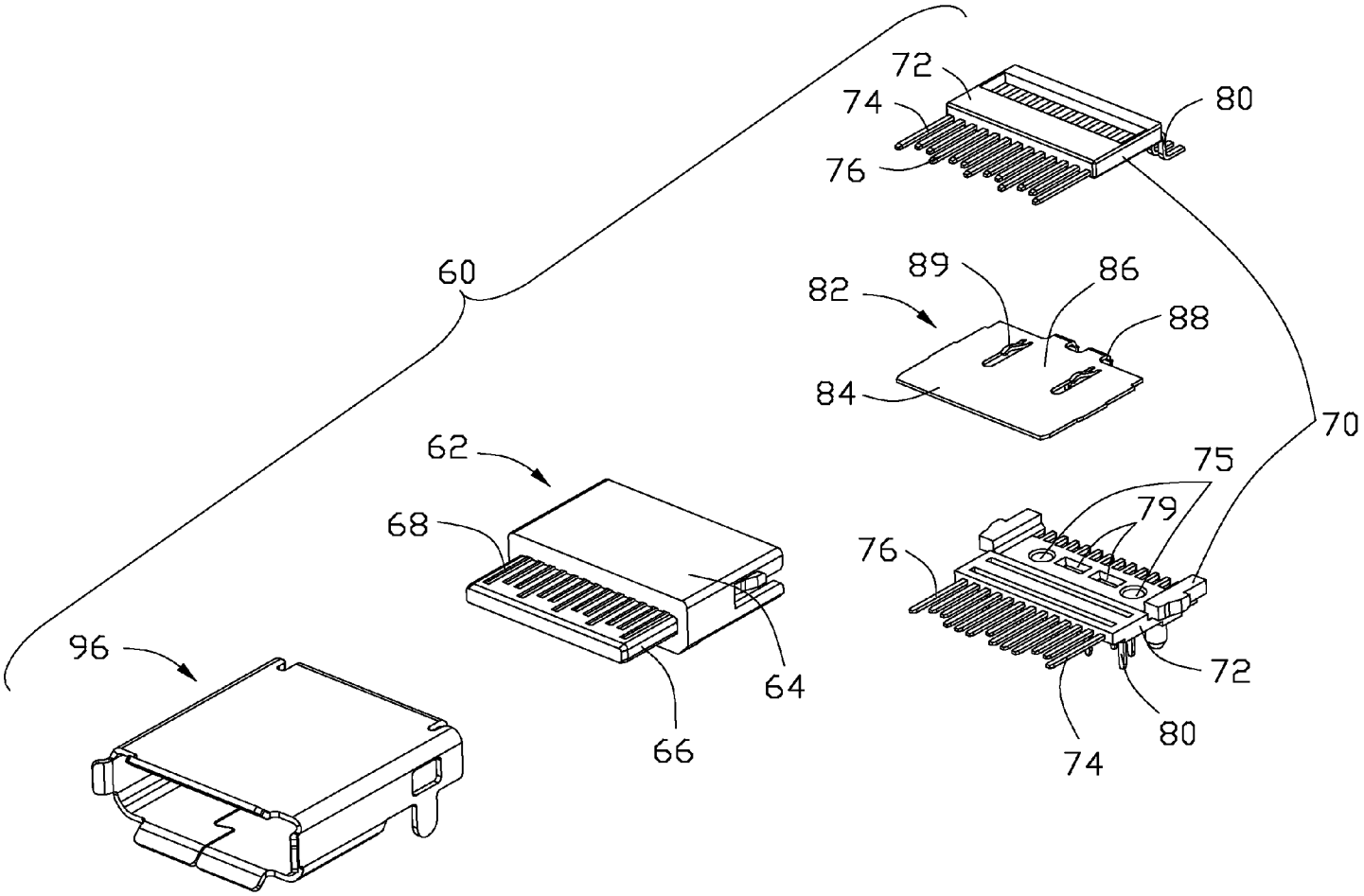
FIG. 10 is an exploded downward perspective view of the receptacle connector of FIG. 8.
Figure 11:
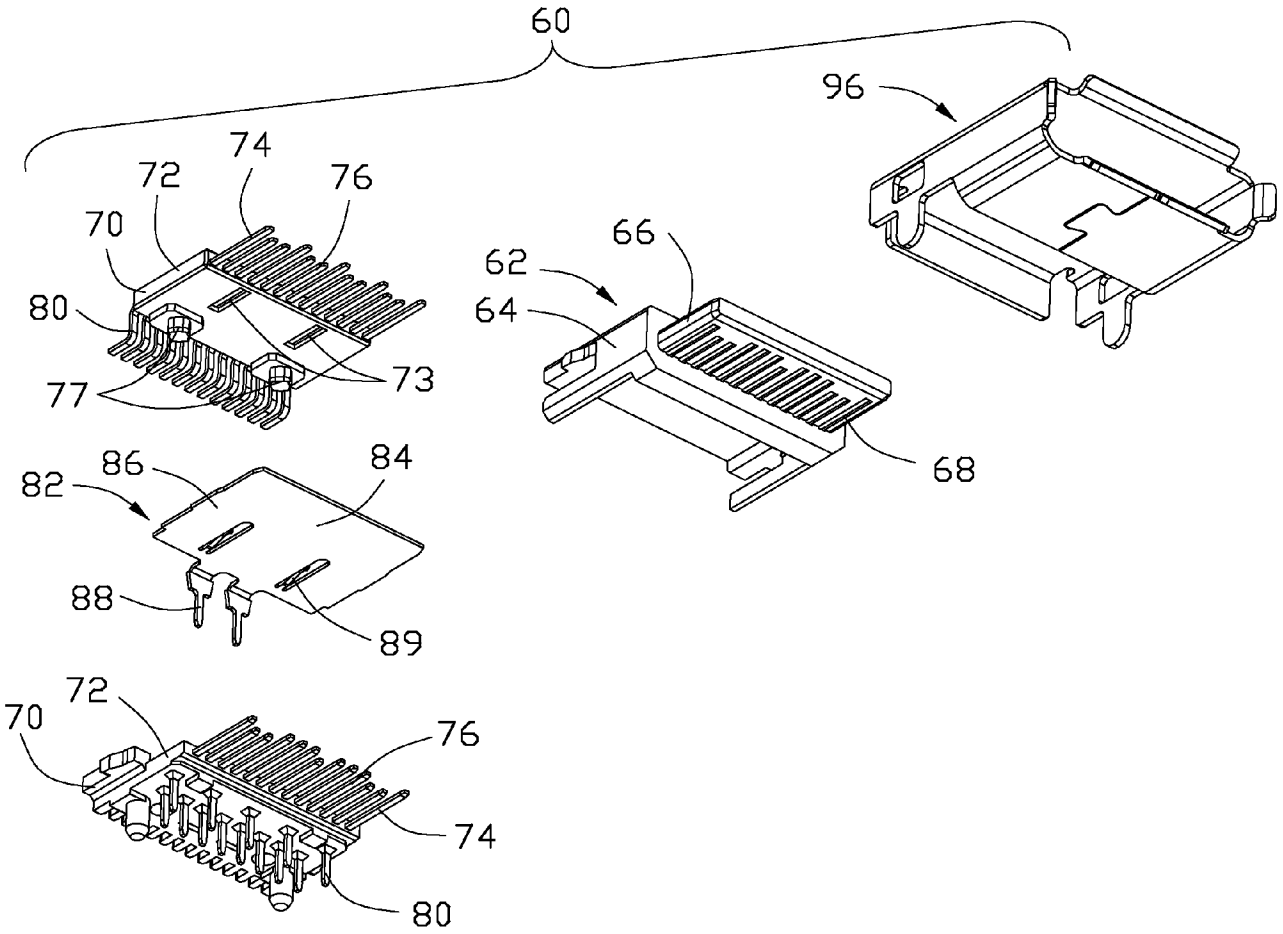
FIG. 11 is an exploded upward perspective view of the receptacle connector of FIG. 8.
Figure 12:
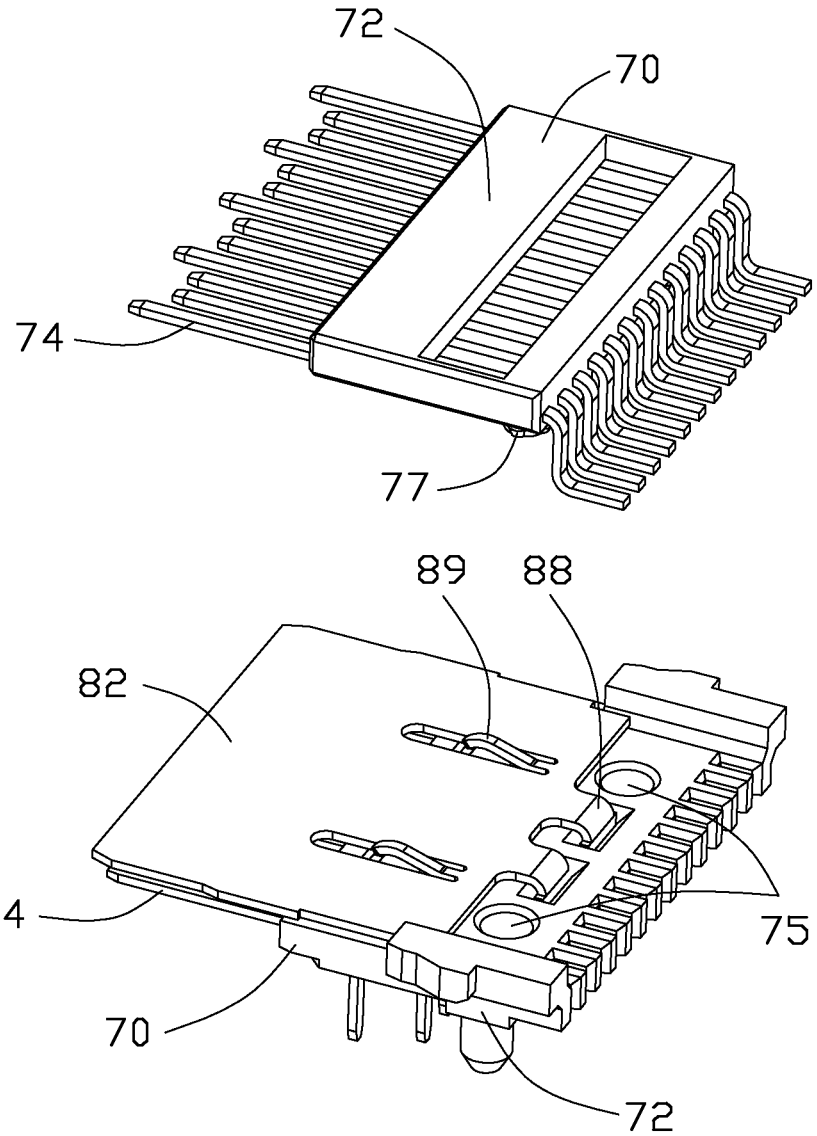
FIG. 12 is a partially assembled downward perspective view of the terminal modules of receptacle connector.
Figure 13:
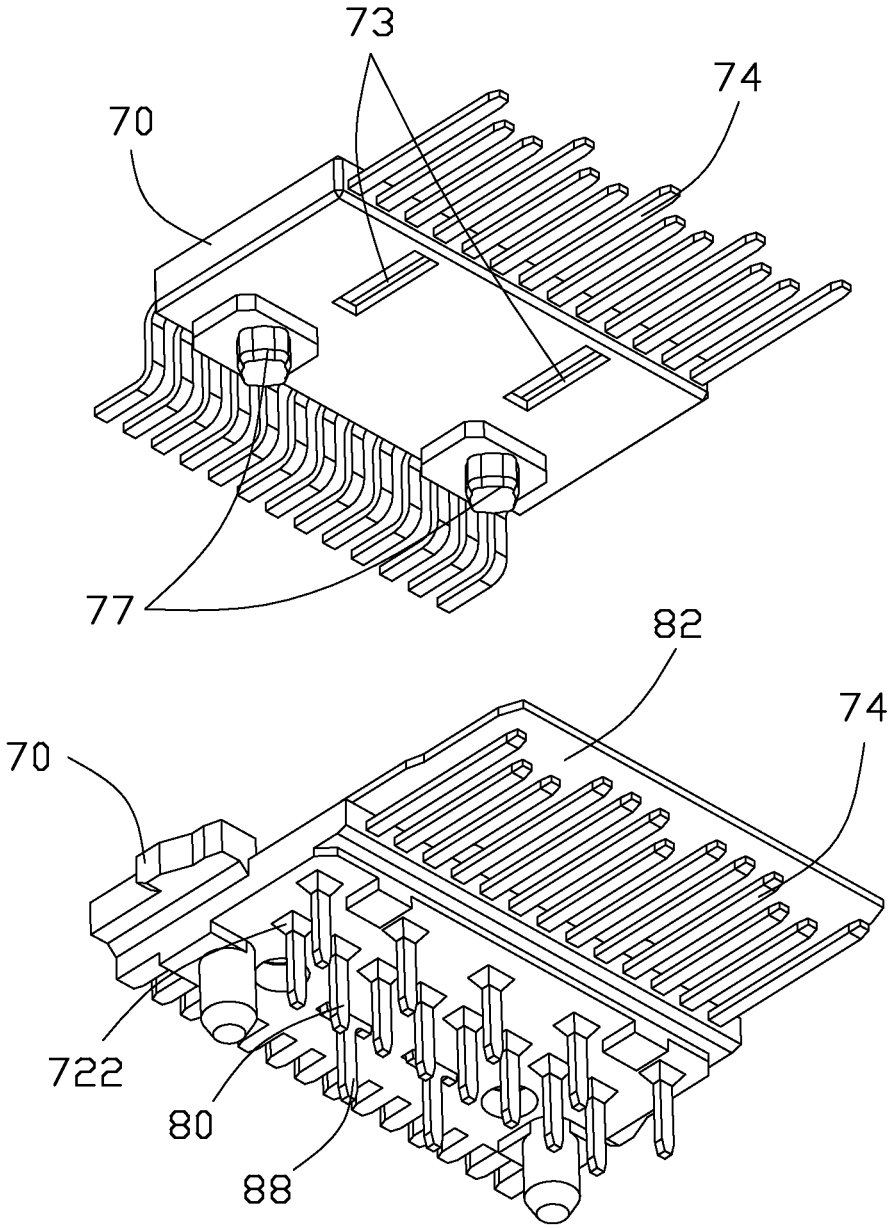
FIG. 13 is a partially assembled upward perspective view of the terminal modules of receptacle connector.
Figure 14:
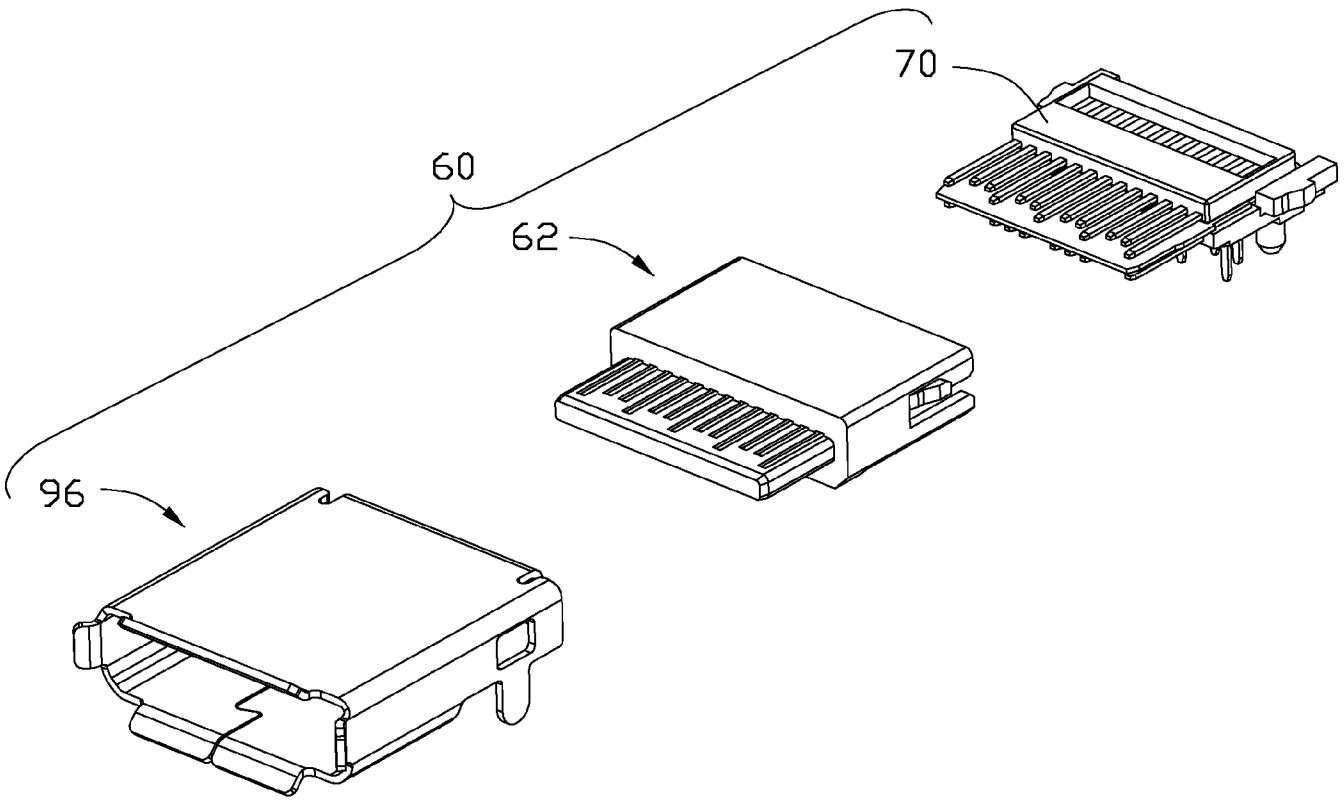
FIG. 14 is a exploded perspective view of the receptacle connector with the terminal modules are preassembled together.

Referring to FIGS. 8-14, a receptacle connector 60 of another embodiment of the present invention includes an insulative housing 62 defining a rear base 64 and a front mating tongue 66 extending forwardly from the base portion 64 and defining opposite upper and lower surfaces thereon. A plurality of contact receiving passageways 68 are formed in the corresponding upper and lower surfaces. Upper and lower terminal modules 70 are stacked with each other in a vertical direction. Each of the upper and lower terminal modules 70 includes an insulator 72 received in the base 64, and a plurality of contacts 74 are integrally insert-molded in the insulator 72. Similar to those in the first embodiment, those contacts 74 are categorized with the differential pairs, the grounding contacts and the power contacts mixed up with one another. Each of the contacts 74 includes a front contacting section 76 extending from a front end of the insulator 72 and received in the corresponding passageway 68, a middle retention section 78 as best shown in FIG. 9 embedded within the insulator 72 and a rear tail section 80 extending out of the insulator 72 and the housing 62 for mounting to a printed circuit board.

A metallic shielding/reinforcement plate 82 is sandwiched between the upper and lower terminal modules 70 and includes a front region 84 inserted into a slit of the mating tongue 66 for reinforcing the mating tongue 66, a middle region 86 sandwiched between the insulators 72 of the upper and lower modules 70, and a rear region 88 extending downwardly through the corresponding through holes 79 of the insulator 72 of the lower terminal module 70 for mounting to the printed circuit board. A pair of spring tangs 89 unitarily extend from the middle region 86 toward to selectively contact the corresponding grounding contacts 74 of the upper terminal module 70. Notably, the insulator 72 of the upper terminal module 70 defines in an underside two apertures 73 corresponding to the selected grounding contacts 74 for allowing such spring tangs 89 to extend therethrough for contacting such selected grounding contacts 74. A metallic shell 96 is assembled to and encloses the housing 62 to cooperate with the mating tongue 66 to define a mating port for receiving a plug.

Different from those in the first embodiment which discloses the terminal modules 20, 22 are assembled into the housing 12 in sequence, the upper and lower terminal modules 70 are first assembled to each other before commonly assembled into the housing 62. Correspondingly, the insulator 72 of the lower terminal module 70 include a pair of mounting holes 75 and an insulator 72 of the upper terminal module 70 includes a pair of mounting posts 77 received in the corresponding mounting holes 75 respectively. Understandably, the shielding/reinforcement plate 82 is structured not to hinder engagement between the mounting posts 77 and the mounting holes 75. Understandably, in some instances at least a portion of the mating tongue 66 may be provided by at least one of the upper and lower terminal modules 70 for consideration of manufacturability. Notably, the lower terminal module 70 further defines shaping convexes 722 corresponding to the tail sections 80 of the contacts 74. The shaping convexes 722 are integrated with a bottom face of the insulator 72 and projecting downwards from the bottom face, which are formed during automotive forming process of the lower terminal module 72. Each tail section 80 is fitly surrounded with one shaping convex 722 and pierce through an apex of the shaping convex 722.

Notably, in the first embodiment, as shown in FIGS. 3, 4 and 15, the contacts 28, 30 defines four channels each including two differential pairs respectively for transmission and reception, and two enlarged power contacts 99, and three pairs of grounding contacts 97 each sandwiching a corresponding differential pair therebetween while sharing a same mounting tail with each other. Therefore, the differential pair 95, which is sandwiched by a pair of grounding contacts 97 sharing the same mounting tail, defines the corresponding mounting tails arranged in one row while the shared mounting tails of those three pairs of grounding contacts 97 are located in another row behind.

What is claimed is:

1. An electrical connector for mating with a plug connector and mounting to a printed circuit board, comprising:

an insulative housing defining a rear base and a front mating tongue extending therefrom with opposite upper and lower surfaces;

opposite upper and lower terminal modules stacked with each other and commonly received with the housing, each of said upper and lower terminal modules including an insulator associated with therewith a plurality of contacts categorized with differential pairs, grounding contacts and power contacts mixed up with one another for coupling to the plug, each of said contacts defining a front immovable contacting section exposed upon the mating tongue for mating with the plug, a middle retention section retained in the insulator for being positioned in the base, and a rear tail section extending out of the insulator for mounting to the printed circuit board; and a metallic shielding/reinforcement plate located between the pair of terminal modules and including a front region located between the contacting sections of the contacts of the opposite upper and lower terminal modules and snugly inserted into the mating tongue for reinforcement, a spring tang mechanically and electrically contacting a selected one of said grounding contact for grounding, and a rear tail section for mounting to the printed circuit board; wherein the front contacting sections of the upper terminal module are upwardly exposed upon the upper surface of the mating tongue in a flush manner, and the front contacting sections of the lower terminal module are downwardly exposed upon the lower surface of the mating tongue in a flush manner.

2. The electrical connector as cited in claim 1, wherein the spring tang is punched from a middle region of the shielding/reinforcement plate in a cantilever manner.

3. The electrical connector as cited in claim 1, wherein the metallic shielding/reinforcement plate defines mounting tabs bending downwards to retain to the lower terminal module, and one of said mounting tabs is equipped with said rear tail section.

4. The electrical connector as cited in claim 1, wherein said lower terminal module defines shaping convexes integrated with the insulator thereof and projecting downwards from a bottom face of the insulator, each rear tail sections of contacts of the lower terminals module is fittingly surrounded with one shaping convex.

5. The electrical connector as cited in claim 1, wherein, the metallic shielding/reinforcement plate is retained by the lower terminal module and the spring tang extends toward one of the upper terminal module and the lower module.

6. The electrical connector as cited in claim 5, wherein said one of the upper terminal module defines an aperture to accommodate the spring tang.

7. A receptacle electrical connector comprising:

an insulative housing defining a rear base and a front mating tongue, the rear base defining a receiving cavity opening rearwards;

a first terminal module and a second terminals module stacked with each other and commonly received in the receiving cavity, each of the first and the second terminal modules including an insulator associated with therewith a plurality of contacts categorized with differential pairs and grounding contacts mixed up with one another, each of said contacts defining a front contacting section exposed upon the mating tongue, a middle retention section retained in the insulator for being positioned in the receiving cavity, and a rear tail section extending out of the insulator; and a metallic plate located between the first and second terminal modules, the metallic plate including a front region snugly inserted into the mating tongue, a spring tang mechanically and electrically contacting one of said grounding contacts for grounding and a rear tail section; wherein one of said first terminal module and said second terminal module forms an aperture to accommodate said spring tang.

8. The receptacle connector as cited in claim 7, wherein the rear tail section of the metallic plate is located between the rear tail sections of the second terminal module and the rear tail sections of the first terminal module in a front-to-rear direction.

9. The receptacle connector as cited in claim 7, wherein the second terminal module has no projecting portion higher than the spring tangs so that the first terminal module is inserted into the receiving cavity after the second terminal module is retained in the receiving cavity.

10. The receptacle connector as cited in claim 7, wherein one insulator of the first and the second terminal module defines a pair of mounting holes, the other insulator of the first and the second terminal module defines a pair of mounting posts received in the corresponding mounting holes.

11. The receptacle connector as cited in claim 9, wherein the second terminal module defines a through hole to receiving the rear tail section of the metallic plate, and the through hole is located between said two mounting holes in line.

12. The receptacle connector as cited in claim 7, wherein said shielding plate is attached to the second terminal module.

13. An electrical connector for mating with a complementary connector, comprising:

opposite upper and lower terminal modules stacked with each other in a vertical direction, each of said upper and lower terminal modules including an insulator associated with therewith a plurality of contacts categorized with differential pairs, grounding contacts and power contacts mixed up with one another along a transverse direction perpendicular to said vertical direction for coupling to the plug, each of said contacts defining a front contacting section exposed upon a mating tongue for mating with the plug, a middle retention section retained in the insulator, and a rear tail section extending out of the insulator for mounting to a printed circuit board; and a metallic shielding plate located between the upper and lower terminal modules and including a spring tang mechanically and electrically contacting a selected grounding contact for grounding; wherein said shielding plate and said upper and lower terminal modules are configured to allow said shielding plate to be relatively assembled to at least one of said upper and lower terminal modules in only said vertical direction instead of a front-to-back direction perpendicular to both said vertical direction and said transverse direction; wherein the insulator of one of the upper and the lower terminal modules defines at least one hole into which at least one mounting tab of the shielding plate extends in the vertical direction for retention.

14. The electrical connector as claimed in claim 13, wherein the insulator of one of said upper and lower terminal modules defines an aperture to allow the spring tang to extending therethrough to contact the selected grounding contact.

15. The electrical connector as claimed in claim 13, wherein the contacts of the lower terminal module are insert molded with the corresponding insulator with through hole type tail sections while the contacts of the upper terminal module are insert molded with the corresponding insulator with surface mount tail sections.

16. The electrical connector as claimed in claim 15, wherein the insulator of the lower terminal module defines a plurality of grooves in which tail sections of the upper terminal module are received.

17. The electrical connector as claimed in claim 13, further including an insulative housing unitarily formed with a front mating tongue and a rear receiving cavity, wherein the stacked upper and lower terminal modules are received in the receiving cavity and the front contacting sections of said contacts are exposed upon two opposite surfaces of the mating tongue in the vertical direction.

18. The electrical connector as claimed in claim 17, wherein said shielding plate includes a front region located between the front contacting sections of the contacts of the upper terminal module and those of the lower terminal module and extending forwardly into the mating tongue for reinforcement.

19. The electrical connector as claimed in claim 18, wherein the spring tang is located in a middle region of the shielding plate behind the front region.

20. The electrical connector as claimed in claim 13, wherein the at least one mounting tab is further equipped with a tail downwardly extending through the insulator of the lower terminal module for mounting to said printed circuit board.

* * * * *